US010995611B2

(12) United States Patent
Perry et al.

(10) Patent No.: US 10,995,611 B2
(45) Date of Patent: May 4, 2021

(54) DOWNHOLE TOOL WITH MULTIPLE WELDED SECTION

(71) Applicant: APS Technology, Inc., Wallingford, CT (US)

(72) Inventors: Carl Allison Perry, Middletown, CT (US); Christopher S. Funke, Jr., West Haven, CT (US); Guy Daigle, Bristol, CT (US); William E. Breuer, Jr., Cromwell, CT (US); Richard Matthew Rothstein, Durham, CT (US)

(73) Assignee: APS Technology, Inc., Wallingford, CT (US)

( * ) Notice: Subject to any disclaimer, the term of this patent is extended or adjusted under 35 U.S.C. 154(b) by 165 days.

(21) Appl. No.: 16/058,073

(22) Filed: Aug. 8, 2018

(65) Prior Publication Data

US 2019/0048716 A1 Feb. 14, 2019

Related U.S. Application Data

(60) Provisional application No. 62/542,637, filed on Aug. 8, 2017.

(51) Int. Cl.

| | |
|---|---|
| ***E21B 17/18*** | (2006.01) |
| ***E21B 17/04*** | (2006.01) |
| ***E21B 49/00*** | (2006.01) |
| ***E21B 7/06*** | (2006.01) |
| ***E21B 17/00*** | (2006.01) |
| ***E21B 47/14*** | (2006.01) |

(52) U.S. Cl.
CPC ..... *E21B 49/00* (2013.01); *E21B 7/06* (2013.01); *E21B 17/00* (2013.01); *E21B 17/04* (2013.01); *E21B 17/18* (2013.01); *E21B 47/14* (2013.01)

(58) Field of Classification Search
CPC ..... E21B 17/18; E21B 17/04; E21B 17/00
See application file for complete search history.

(56) References Cited

U.S. PATENT DOCUMENTS 4,712,424 A * 12/1987 Herron ..... G01V 11/00 250/256
5,357,481 A * 10/1994 Lester ..... G01V 1/523 367/31

(Continued)

*Primary Examiner* — Cathleen R Hutchins
(74) *Attorney, Agent, or Firm* — Offit Kurman, P.A.; Gregory A. Grissett

(57) ABSTRACT

A downhole tool is described that includes at least three sections welded together. The downhole tool has a downhole section, an intermediate tool section mounted to the downhole section with a lower weldment, and an uphole section positioned opposite the downhole section mounted to the intermediate tool section with an upper weldment. The downhole tools as described herein include an elongate internal passage that extends from the downhole section to the uphole section through the lower weldment and the upper weldment. The elongate internal passage is sized to receive drilling fluid therethrough. Furthermore, one or more of the downhole section, the intermediate tool section, and the uphole section includes: a) at least one sensor module, b) a cavity, and c) a plurality of bores (holes). In certain embodiments, the downhole tool may be triple combo tool, an acoustic logging tool, or a directional tool, such as a steerable tool.

30 Claims, 11 Drawing Sheets

(56) References Cited

U.S. PATENT DOCUMENTS

| | | | | |
|---|---|---|---|---|
| 5,886,303 | A * | 3/1999 | Rodney | G01V 1/46 181/102 |
| 6,634,427 | B1 * | 10/2003 | Turner | E21B 17/028 166/242.3 |
| 2005/0150692 | A1 * | 7/2005 | Ballantyne | E21B 7/062 175/61 |
| 2017/0306709 | A1 * | 10/2017 | Cull | E21B 21/12 |

* cited by examiner

DOWNHOLE TOOL WITH MULTIPLE WELDED SECTION

CROSS-REFERENCE TO RELATED APPLICATIONS

The present application claims priority to and the benefit of U.S. Provisional Application No. 62/542,637, filed Aug. 8, 2017, the entire disclosure of which is incorporated by reference into this application for all purposes.

TECHNICAL FIELD

The present disclosure relates to a downhole tool comprised of multiple sections welded together with internal bores and unique structure features and/or complex geometry within the sections. The bores/features may facilitate the electrical or hydraulic connection of multiple devices, such as sensors and other components, arranged at spaced apart positions along the length of the sections. This present disclosure also relates to methods of manufacturing downhole tools with multiple sections comprising internal bores.

BACKGROUND

Drilling assemblies for boring holes deep into the earth are well known. For example, drilling assemblies are used by the oil and gas industry for retrieving various fluids and gases buried within earth formations. Typical drilling assemblies comprise a drilling string including a plurality of interconnected sections with a drill bit on the end thereof. Rotating the interconnected sections may rotate the drill bit. Alternatively, the interconnected sections may be held static and the drill bit rotated by employing internally disposed mechanisms that are driven by drilling fluid commonly referred to as "mud," which is supplied under pressure from a surface source into the drill string. The drilling fluid discharges at the drill bit and returns to the surface through the annular space between the drill string and the wellbore wall. Fluid returning to the surface may carry cuttings produced by the drill bit.

Downhole measuring and communication systems frequently referred to as measurement-while-drilling ("MWD") and logging-while drilling ("LWD") are typically disposed within drill string sections above and in close proximity to the drill bit. The systems comprise sensors for collecting down hole parameters, such as parameters concerning the drilling assembly itself, the drilling fluid, and those of formations surrounding the drilling assembly. For example, sensors may be employed to measure the location and orientation of the drill bit, and to detect buried utilities and other objections, critical information in the underground utility construction industry. Sensors may be provided to determine the density, viscosity, flow rate, pressure and temperature of the drilling fluid. Other sensors are used to determine the electrical, mechanical, acoustic and nuclear properties of the subsurface formations being drilled. Chemical detection sensors may be employed for detecting the presence of gas. These measuring and communication systems may further comprise power supplies and microprocessors that are capable of manipulating raw data measured by the various sensors. Information collected by sensors may be stored for later retrieval, transmitted to the earth's surface via telemetry while drilling, or both. Transmitted information provides the bases for adjusting the drilling fluid properties and/or drilling operation variables, such as drill bit speed and direction.

A drill string section including an MWD and/or LWD system will generally have several sensors positioned at spaced apart locations along the length of the drill string, a microprocessor, and a power supply, all being electrically connected by wires. In other applications, such as, for example, pressure sensors, it is desirable to connect spaced apart locations (along a drill collar) hydraulically by fluid passages.

Normally passages are drilled from the ends of the drill string section to house the electrical wires, and thereafter sealed in some manner, such as by welding. The ends of drill string sections usually comprise a coupling means, commonly a threaded portion, such that a plurality of drill sting sections can be directly interconnected without employing additional hardware. Unfortunately, the presence of the passages within a threaded end region creates stress risers that may lead to structural failure of the drill string section. Passages within the threaded ends also create problems for threading re-work, which is beneficial for extending the life of a drill string section.

One solution to the above-identified problems that has been used in the past is to drill passages from one end of a first drill pipe and towards its opposing end, seal the passage opening, and then weld a second drill pipe that does not contain any passages to the sealed end of the first drill pipe. A threaded connection can then be formed on the exposed ends of the connected drill pipes, thereby maintaining the passage internally and distal to the threaded connections. This drill string section manufacturing technique, however, has limitations. The first drill pipe comprising the wire bore will generally have relatively thicker walls (that is, a relatively smaller bore) to accommodate the wire bore, whereas the second drill pipe will have relatively thinner walls (that is, a larger relative bore) to minimize weight and manufacturing cost while maximizing flow rates of drilling fluid. In such a stepped bore arrangement the weld joint is necessarily located, at least partially, in a thin-walled area (interface of the connected first and second drill pipes). This can compromise the structurally integrity of the resulting drill string section, and limit the maximum strain the drill string section can tolerate before failure. Another limitation of this manufacturing technique is the length of the drill string section and number of sensors accommodatable therewith. It is preferred to have drill string sections as long as possible to improve drilling efficiency, and to employ several sensors and corresponding electrical devices. Since the wire bore is only formed in the first section of drill pipe, the overall length of the drill string section will be limited to that of current methods of small diameter and long hole drilling.

Another solution has been to drill radially offset, axially extending holes in two sections of pipe that are then welded together and a hole drilled at an acute angle through the weld joint to connect the offset passages. This approach is disclosed in U.S. Pat. No. 6,634,427, entitled "Drill String Section With Internal Passage," which is hereby incorporated by reference herein in its entirety. Unfortunately, this approach also has several drawbacks. Drilling the acute angle hole requires the use of a five axis milling center or a manual drilling process with multiple machining steps. Further, the intersection of the connecting hole and the axial hole may have sharp edges that cannot be easily deburred but which might cut wires extending through the hole. Finally, the angled connecting hole is not optimal for routing wires.

SUMMARY

Accordingly, a need still exists for improved methods of manufacturing downhole sections that comprise lengthy internal passages, bores, and complex cavities, and that overcome problems such as those described above.

An embodiment of the present disclosure is a downhole tool that includes at least three sections welded together. The downhole tool has a downhole section, an intermediate tool section mounted to the downhole section with a lower weldment, and an uphole section positioned opposite the downhole section mounted to the intermediate tool section with an upper weldment. The downhole tools as described herein include an elongate internal passage that extends from the downhole section to the uphole section through the lower weldment and the upper weldment. The elongate internal passage is sized to receive drilling fluid therethrough. Furthermore, one or more of the downhole section, the intermediate tool section, and the uphole section includes: a) at least one sensor module, b) a cavity, and c) a plurality of bores (holes). In certain embodiments, the downhole tool may be triple combo tool, an acoustic logging tool, or a directional tool, such as a steerable tool.

An embodiment of the present disclosure is a method of manufacturing a portion of a downhole tool having an internal passage extending along a substantial length thereof. The method comprising the steps of: (a) drilling a first approximately axially extending hole in a first elongate section, the first elongate section having first and second ends and an approximately circular cross-section and defining an axial centerline thereof, the first hole being radially displaced from the axial centerline of the first elongate section by a first distance, a first end of the first hole forming an opening in the first end of the first elongate section; (b) drilling a second approximately axially extending hole in a second elongate section, the second elongate section having first and second ends and an approximately circular cross-section and defining an axial centerline thereof, the second hole being radially displaced from the axial centerline of the second elongate section by the first distance, a first end of the second hole forming an opening in the first end of the second elongate section; (c) aligning the first ends of the first and second elongate sections so that the first and second holes are substantially radially and circumferentially aligned and so that the openings in the ends of the first and second holes are proximate one another and axially displaced by a second distance; (d) joining the first ends of the mated first and second elongate sections by depositing a circumferentially extending weld bead therebetween, the weld bead at least spanning the second distance between the openings in the first ends of the first and second holes; (e) forming an approximately radially extending through hole through a portion of the weld bead that intersects with the first ends of the first and second holes so as to place the first and second holes in communication therebetween, whereby the first and second holes form the internal passage; and (f) plugging the through hole.

DETAIL DESCRIPTION OF EMBODIMENTS

Embodiments of the present disclosure includes a downhole tool 50, 60, 100, 300 that includes at least three sections welded together. For instance, downhole tools 50, 60, 100, 300 as described herein include a downhole section, and an intermediate tool section mounted to the downhole section with a lower weldment, and an uphole section positioned opposite the downhole section along an axial direction and mounted to the intermediate tool section with an upper weldment. The downhole tools as described herein include an elongate internal passage that extends from the downhole section to the uphole section through the lower weldment and the upper weldment. The elongate internal passage is sized to receive drilling fluid therethrough. Furthermore, one or more of the downhole section, the intermediate tool section, and the uphole section include one or more of: a) at least one structural feature or unique geometry, b) at least one sensor, c) a cavity, and/or d) a plurality of bores.

Figure 1A:
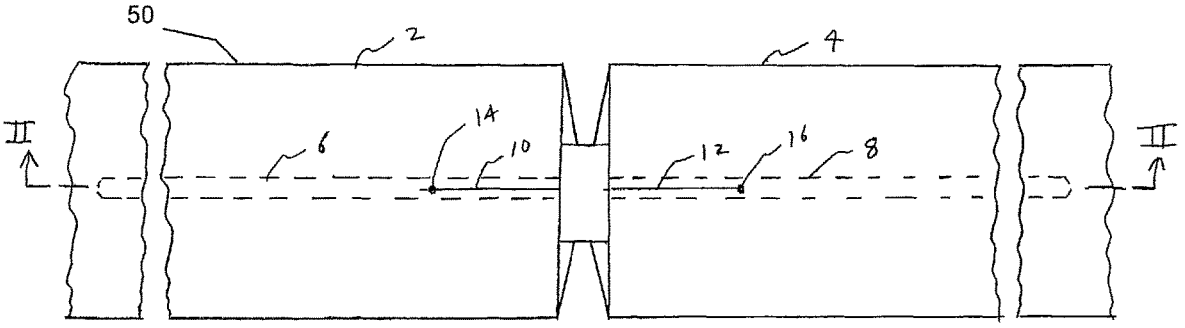
FIG. 1A is a view of two sections of a downhole tool.

According to an embodiment, a downhole tool 50 incorporating a long axially extending passage that can be used, for example, to route wires or connect hydraulic passages, is formed from two sections of bar stock 2, 4, shown in FIG. 1A. The bar stock can be made of any material suitable for a drill string section, such as steel. At least one, and preferably each section of bar stock 2, 4, has a length that is greater than 24 inches, 95 inches and, or even greater 125 inches. In one embodiment, the outer diameter of the sections 2, 4 is about 7 inches.

Figure 1B:
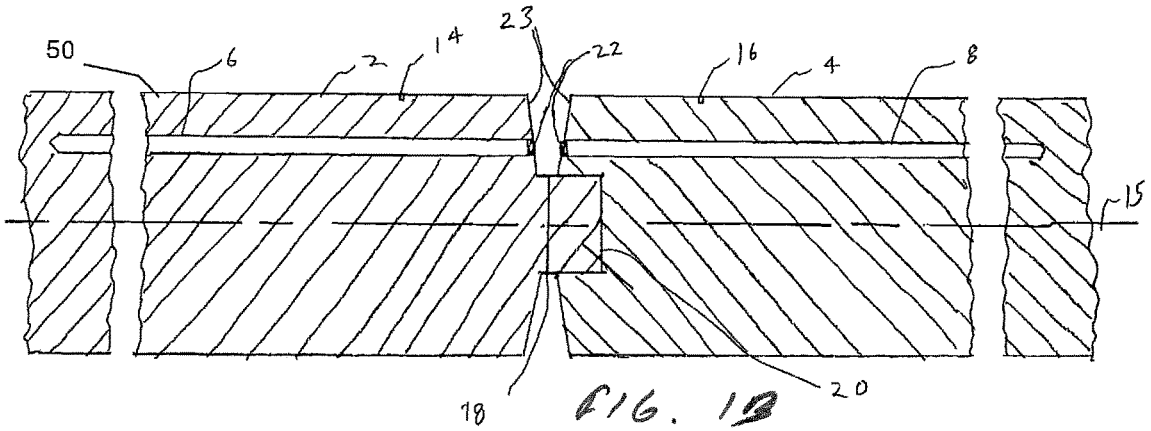
FIG. 1B is a longitudinal cross section taken through line II-II shown in FIG. 1.

As shown in FIGS. 1A and 1B, a blind hole 6 is drilled in one end of section 2 at a radial distance from the centerline 15 of section 2. Another blind hole 8 is drilled in one end of section 4 the same radial distance from the centerline 15 of section 4. In one embodiment, the diameter of the holes 6, 8 is about ⅜ inch. Preferably each blind hole 6, 8 has a length that is at least 24 inches, 95 inches and, or even greater 125 inches. In one embodiment, the outer diameter of the sections 2, 4 is about 7 inches.

In preparation for welding, a bevel 23 is formed in the end of each section 2, 4 in which the blind holes 6, 8 are drilled. After machining the bevels 23, the open end of each hole 6, 8 is sealed by tack welding a thin disk 22 over the opening. Preferably, the disk 22 is about 1/16 inch thick. In addition, a key 18 is machined in the end of section 2 and a aligning keyway 20 is machined in the end of section 4.

As shown in FIG. 1B, reference indicators, preferably in the form of lines 10, 12 are created, preferably by scribing, adjacent the end of each section 2, 4. The lines 10, 12 are circumferentially aligned with the holes 6, 8. The scribe lines 10, 12 aid in circumferentially aligning the sections 2, 4 so that the holes 6, 8 are aligned when the sections are welded together. As shown in FIGS. 1A and 1B, a small, shallow hole 14 is drilled in the scribe line 10 a distance from the end of section 2. A second small, shallow hole 16 is drilled in the scribe line 12 an equal distance from the end of section 4. The holes 14, 16 aid in locating the joint between the two sections 2, 4 when a radial hole is drilled as discussed below. In one embodiment, the holes 14, 16 are ⅛ inch in diameter and ⅛ inch deep.

After the pre-machining discussed above, the section 2, 4 are mated together by inserting the key 18 into the keyway 20, as shown in FIG. 1B. The scribe lines 10, 12 are used to ensure that the blind holes 6, 8 are circumferentially aligned. Since the holes 6, 8 were located at the same radial distance from the centerline 15 of section 2, 4, when circumferentially aligned after aligning, the holes are aligned in both the radial and circumferential directions.

Figure 1C:
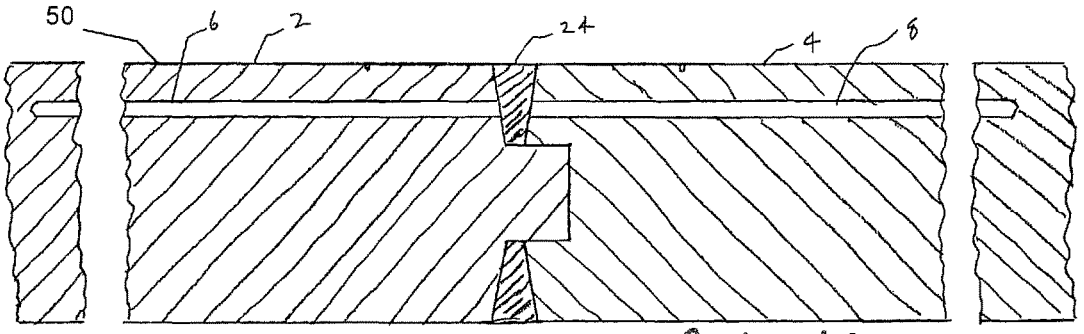
FIG. 1C is a view similar to FIG. 1B after formation of a weld bead between the two sections.
Figure 1D:
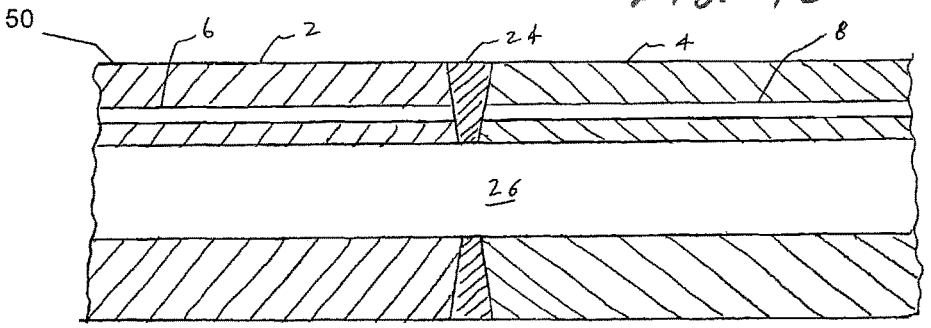
FIG. 1D is a view similar to FIG. 1C after the drilling of a central bore.

As shown in FIG. 1C, after aligning the sections 2, 4 so as to align the holes 6, 8, a weld bead 24 is deposited between the beveled ends 23 so as to join the section 2, 4 into a single section. As shown in FIG. 1D, a central bore hole 26 is drilled concentric with the center line 15 of the sections 2, 4. In one embodiment, the diameter of the central hole 26 is about 3 inches.

Figure 2:
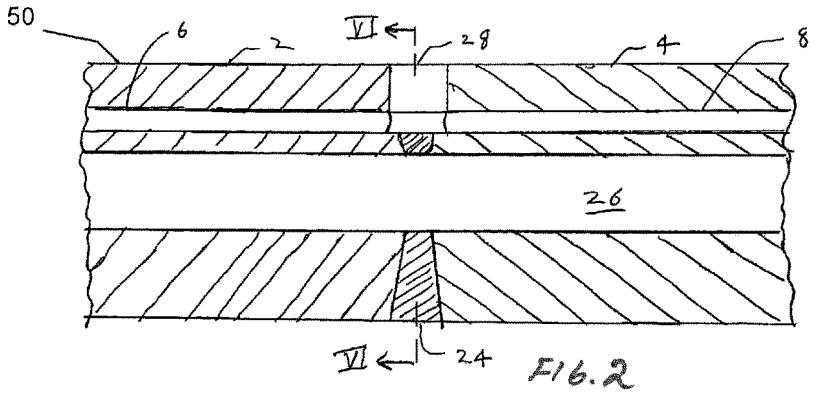
FIG. 2 is a view similar to FIG. 1D after the drilling of a radial hole.
Figure 3:
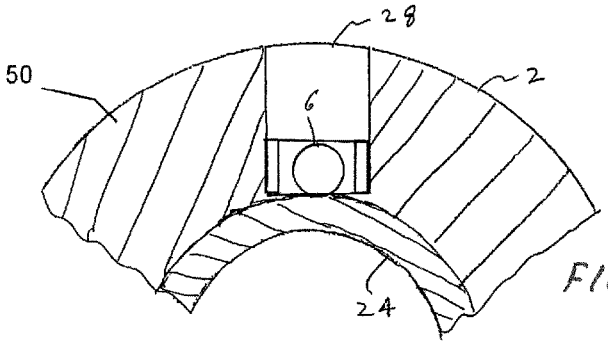
FIG. 3 is a transverse cross section taken through line VI-VI shown in FIG. 2.

As shown in FIGS. 2 and 3, a blind, radially extending hole 28 is drilled into the weld bead 24 that places the holes 6, 8 in communication so as to form a unitary internal passage. The depth of the blind hole 28 is such that the bottom of the hole is located at the radially inward most surface of the holes 6, 8, as shown best in FIG. 3. In one embodiment, the diameter of the radial hole 28 is about 1⅛ inch, formed by first drilling a 1 inch diameter hole and then enlarging it to a 1⅛ inch diameter hole. The surfaces formed by the intersection of hole 28 and holes 6,8 are then deburred.

The location and diameter of the hole 28 provide access to these intersecting surfaces that facilitates the deburring. In addition, the radial holes 28 can be drilled by a simple drilling or milling machine.

Figure 4:
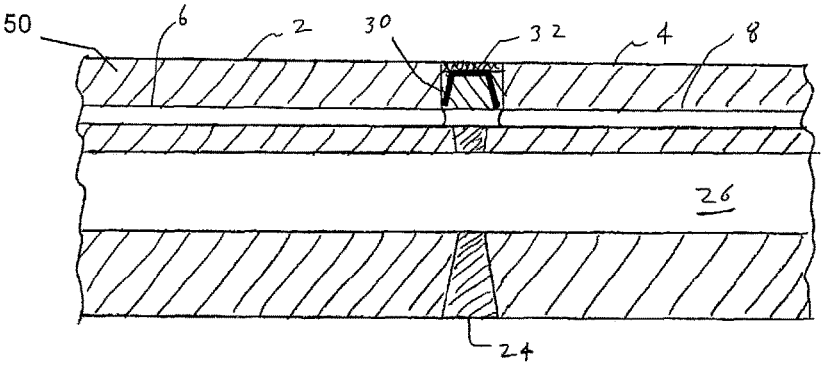
FIG. 4 is a view similar to FIG. 2 after installing a plug into the radial hole.

After drilling the radial hole 28, the outer diameter of the section is machined to its final diameter so as to eliminate the holes 14, 16 and clean up the weld bead 24. As shown in FIG. 4, a plug 30 is inserted into the radial hole 28 to seal the passage. Preferably, the bottom of the plug 30 is aligned with the radially outward most portion of the holes 6, 8. Preferably, the plug is retained by an interference fit—that is, the outer diameter of the plug 30 is slightly greater than the inner diameter of the radial hole 28. In one embodiment, insertion of the plug 28 into the hole 28 is facilitated by heating the section of the drill pipe around the hole 28 and cooling the plug 30. A weld bead 32 is deposited in the hole 28 to ensure retention of the plug 30 and to also add structural rigidity to the tool.

Figure 5:
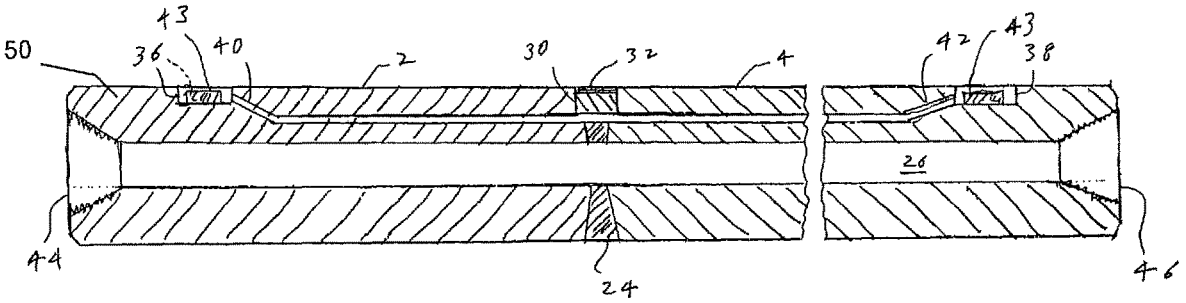
FIG. 5 is a longitudinal cross section through a section of the downhole tool.
Figure 6A:
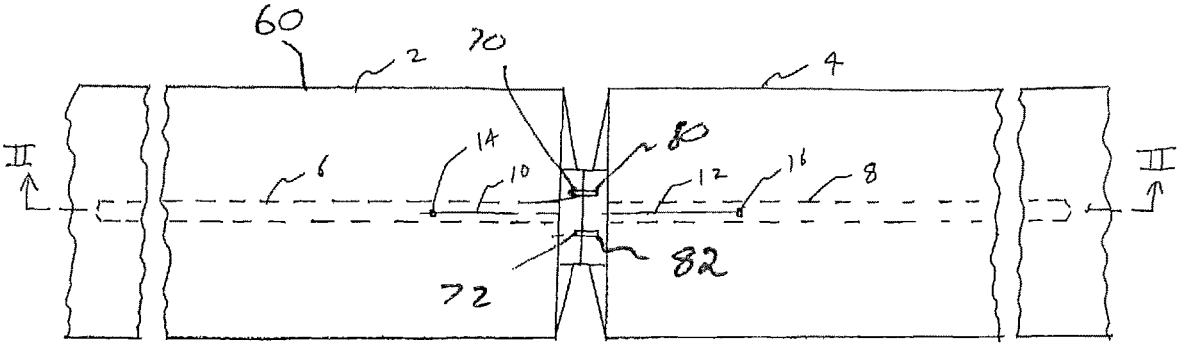
FIG. 6A is a view of two sections of a downhole tool made according to another embodiment of the present disclosure.
Figure 6B:
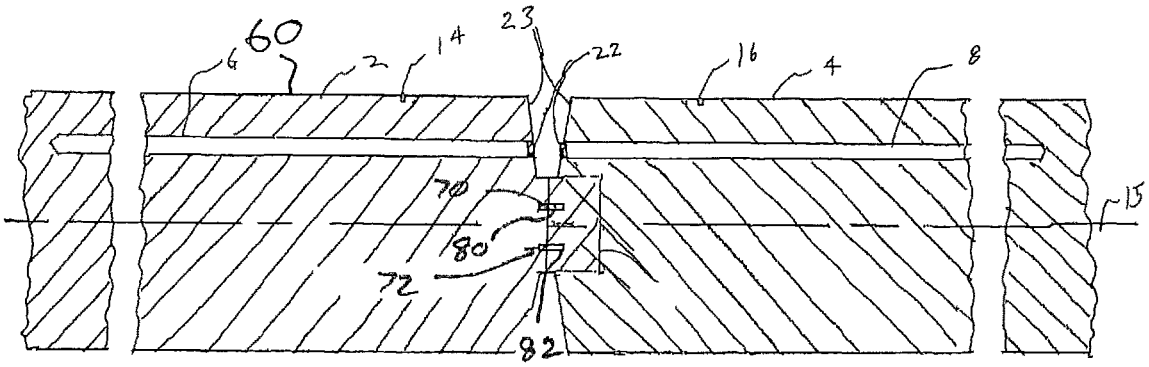
FIG. 6B is a longitudinal cross section taken through line II-II shown in FIG. 6A.
Figure 6C:
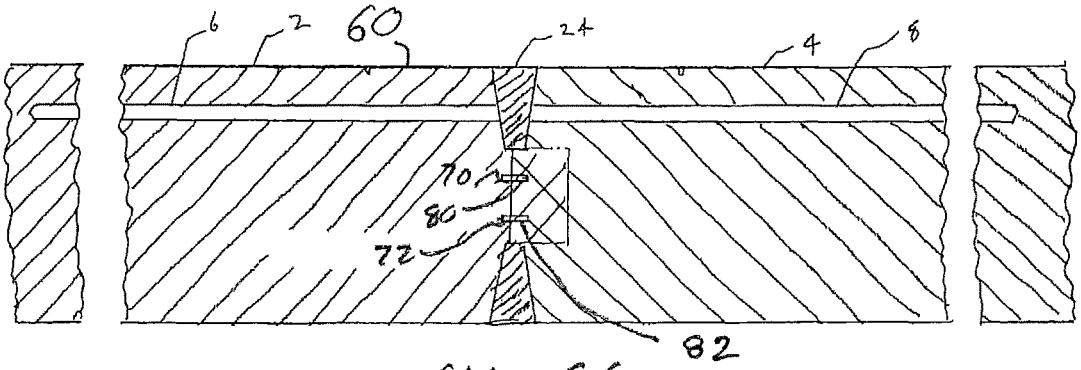
FIG. 6C is a view similar to FIG. 6B after formation of a weld bead between the two sections.
Figure 7:
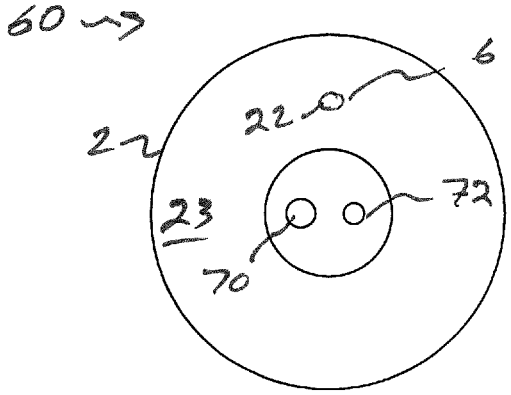
FIG. 7 is an end view of a first section of the tool shown in FIGS. 6A-6C.
Figure 8:
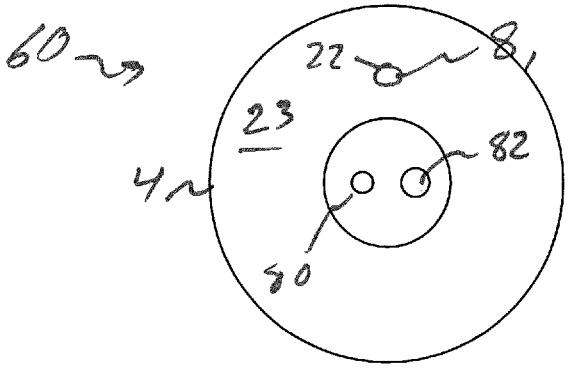
FIG. 8 is an end view of a first section of the tool shown in FIGS. 6A-6C.
Figure 9:
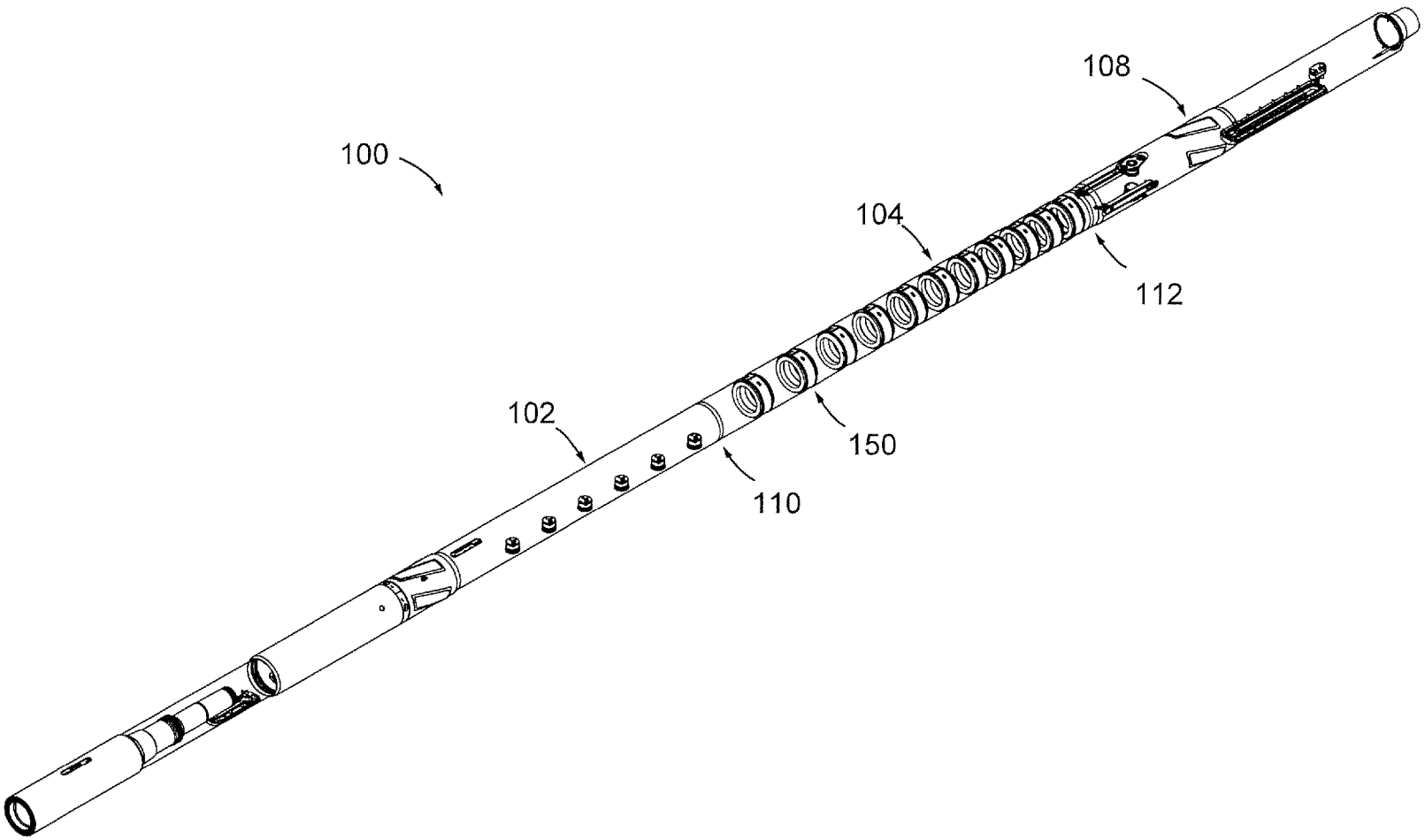
FIG. 9 is a perspective view of an acoustic logging tool according to an embodiment of the present disclosure.
Figure 10:
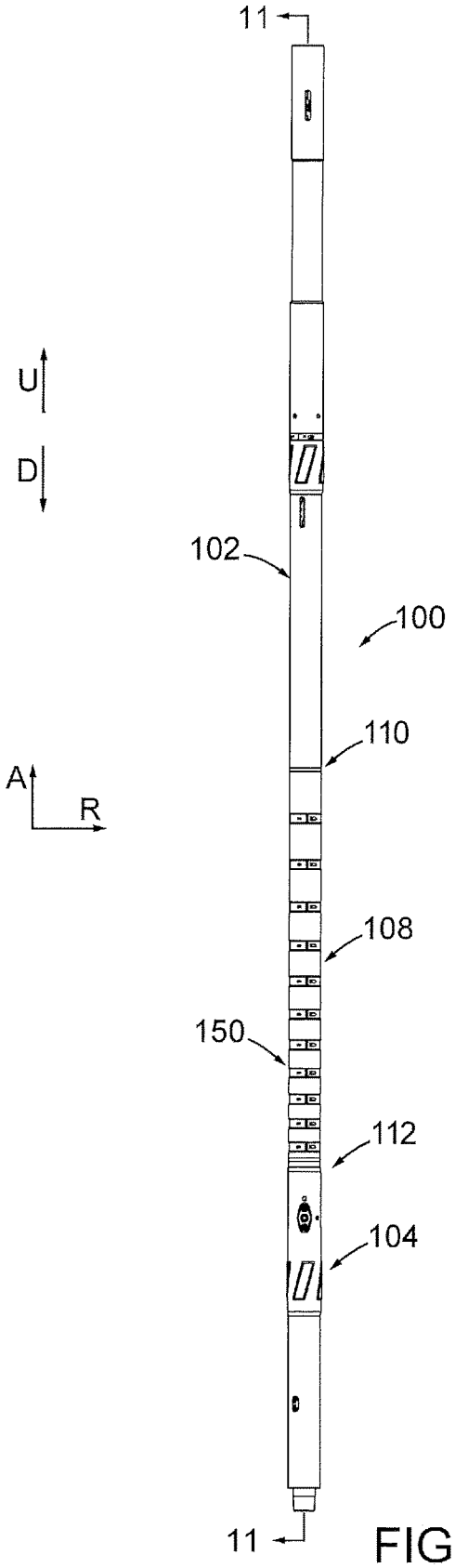
FIG. 10 is a side view of the acoustic logging tool shown in FIG. 9.
Figure 11:
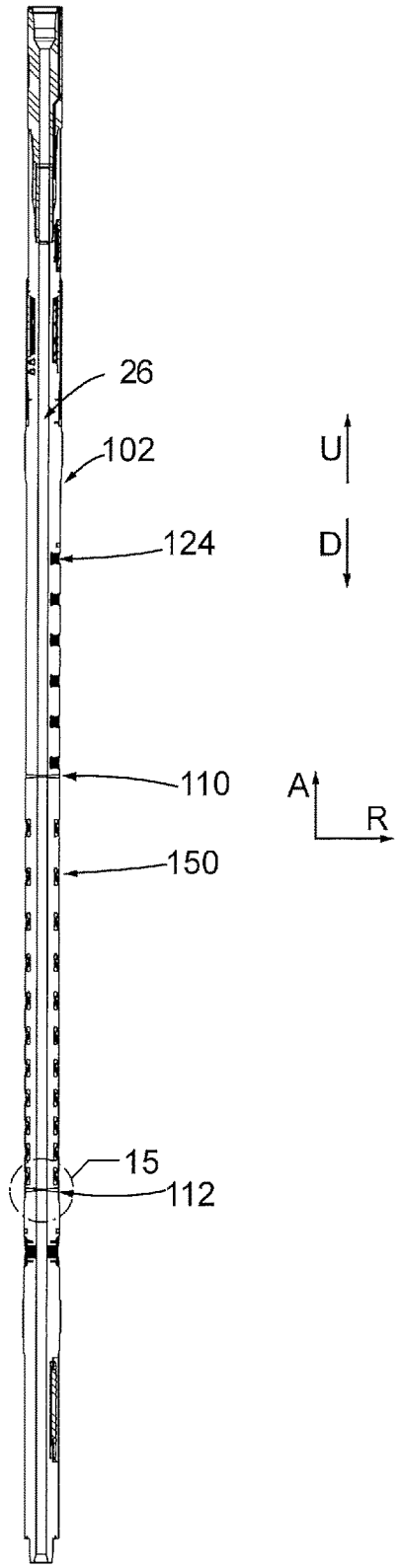
FIG. 11 is a cross-sectional view of the acoustic logging tool taken along the line 11-11 shown in FIG. 10.

As shown in FIG. 5, seats 36, 38 may be formed by methods known to persons having ordinary skill in the art, such as by drilling or milling. Linking passages 40, 42 are cross-drilled from the seats 36, 38 to the holes 6, 8. At least one electrical device 43 may be is disposed within each of the seats 36, 38. Two or more such electrical devices 43 may be electrically connected by wiring extending through the passage formed by the axial holes 6, 8, the radial hole 28, and the linking passages 40, 42. The orientation of the axial holes facilitates the routing of the wires. Alternatively, the linking passages 40, 42 can be eliminated by forming the seats 36, 38 sufficiently deep so that they directly intersect with the holes 6, 8. As also shown in FIG. 8, threads may be formed in the ends 44, 46 of the drill section to facilitate joining the drill section to other sections of the drill pipe.

Although the invention has been illustrated by drilling the central bore hole 26 after the sections 2, 4 are welded together, the invention could also be practiced by drilling the central bore hole 26 prior to welding the sections together. Moreover, the central bore hole 26 in each section need not be the same diameter. Although the invention has been illustrated by using a key 18 and keyway 20 to facilitate the aligning and alignment of the sections 2, 4, an alignment sleeve could also be employed, as disclosed in the aforementioned U.S. Pat. No. 6,634,427.

An alternative embodiment of a downhole tool 60 is illustrated in FIGS. 6A-8. The embodiment of the downhole tool 60 is illustrated in FIGS. 6A-8 to substantially similar to the embodiment illustrated in FIGS. 1A-5. For this reasons, features that are common between downhole tool 50 and downhole 60 have the same reference numbers. The downhole tool 60, instead of using a key 18 and keyway 20, includes a plurality of alignment pins 70, 72 and a plurality of alignment bores 80,82 to facilitate alignment of the tool sections.

In accordance with the embodiment shown in FIG. 6A-8, the ends of each tool section 2, 24, includes a bevel 23 in which the blind holes 6, 8 are drilled. After machining the bevels 23, the open end of each hole 6, 8 is sealed by tack welding a thin disk 22 over the opening. A first end of the first elongate section 2 includes a first alignment pin 70 and a second alignment pin 72 that each project axially outward from the first end. In the embodiment shown, the first alignment pin and the second alignment pin have different a) diameters and b) lengths. The second elongate section 4 is machined to include a first bore 80 and a second bore 82 that each extend axially inward from the first end. In the embodiment shown, the first bore 80 is sized to slidably receive the first alignment pin 70, but not the second alignment pin and the second bore 82 is sized to receive the second alignment pin 72 and not the first alignment pin 70. In this manner, the tool sections 2 and 4 can only be mated together one particular way. The different sized alignment pins therefore fix the axial alignment of the two sections but also the rotational alignment of the two section.

While tool sections have either two pins or two alignment bores are shown, it is possible machine each tool section to include one alignment pin and a one alignment bore and achieve the same result. In particular, in yet another embodiment of the present disclosure, the first end of the first elongate section include a) a first alignment pin that projects axially outward from the first end, and b) a first bore that extends axially inward from the first end. The first end of the second elongate section forms a) a second alignment pin that projects axially outward from the first end of the second elongate section, and b) a second bore that extends axially inward from the first end of the second elongate section. In use, in order to align the two sections 2, 4 together one inserts the first alignment pin into the second bore and inserts the second alignment pin into the first bore such that the first and second elongate sections are rotationally aligned with each other. Again, in this manner, the tool sections 2 and 4 can only be mated together one way. In the alternative embodiments, the process continues similarly to that described above with respect to FIGS. 1B-5.

Although the method described herein is with reference to joining two tool sections together with a weld joint, the method is primarily used to join three (or more) elongate tool sections together to form downhole tools, such as a triple combo, an acoustic logging tool, or a directional steering tool. Accordingly, embodiments of the present disclosure include a downhole tool configures as an acoustic logging tool or a triple combo tool.

Referring to FIGS. 9-12, a downhole tool is shown in the form of an acoustic logging tool 100. The acoustic logging tool 100 includes a transmitter section 104, a receiver section 102 spaced uphole from the transmitter section 104 along an axial direction A, and an isolator section 108. In operation, the axial direction A may be coincident with the central axis. The isolator section 108 extends from the transmitter section 104 to the receiver section 102. The isolator section 108 may be joined to the receiver section 102 by an upper weldment 110 and to the transmitter section 104 by a lower weldment 112. An internal passage 26 extends through the tool 100. The upper and lower weldments 110 and 112 are formed as described above.

The isolator section 108 includes at least one cavity 150 configured to disrupt and/or deflect portions of the acoustic signals propagated through the isolator section 108 by the transmitter 172. In the depicted embodiment, the isolator section 108 has a plurality of cavities 150.

Figure 12:
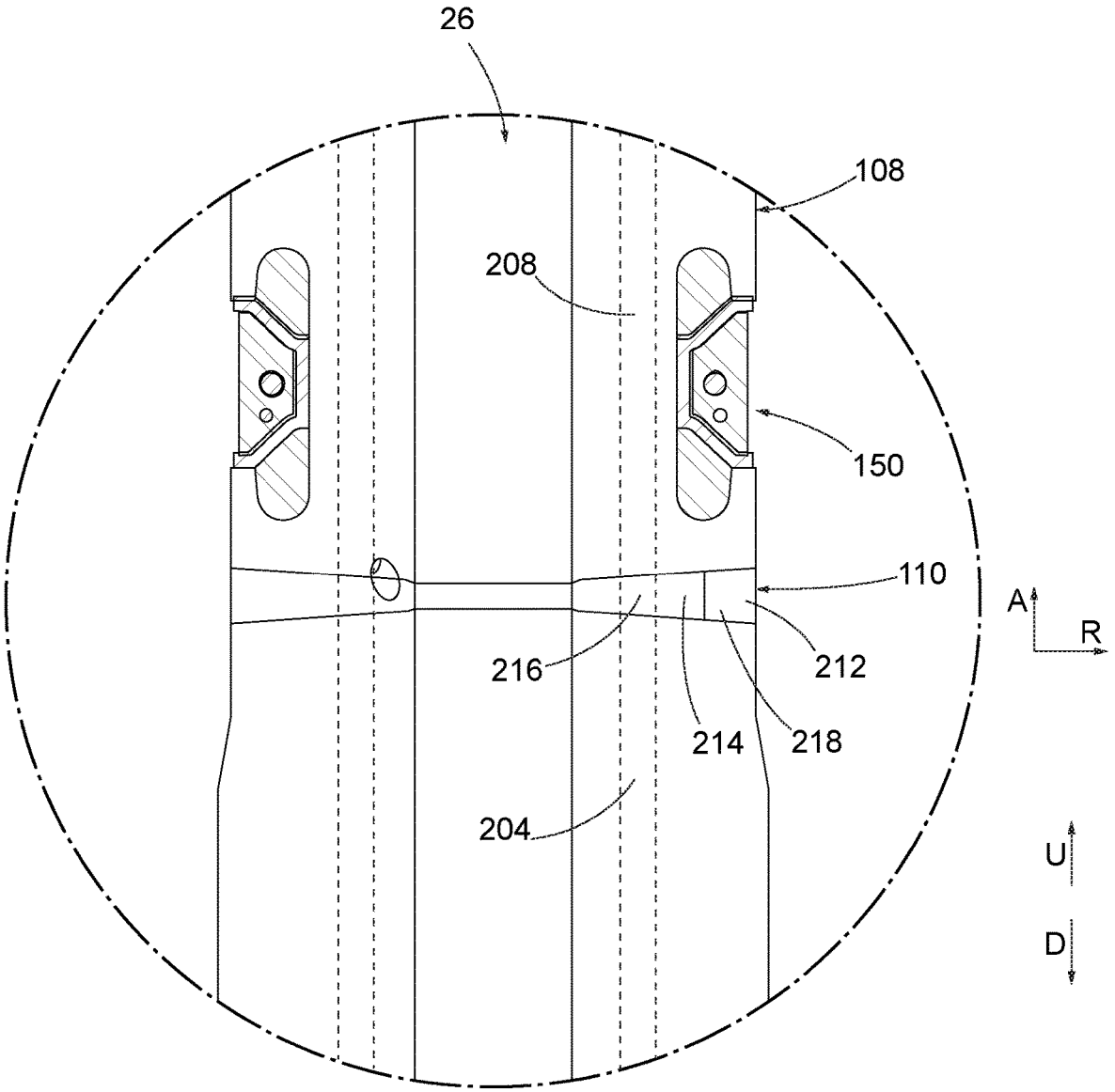
FIG. 12 is a detailed cross-sectional view of the encircled region of the acoustic logging tool shown in FIG. 11.
Figure 13:
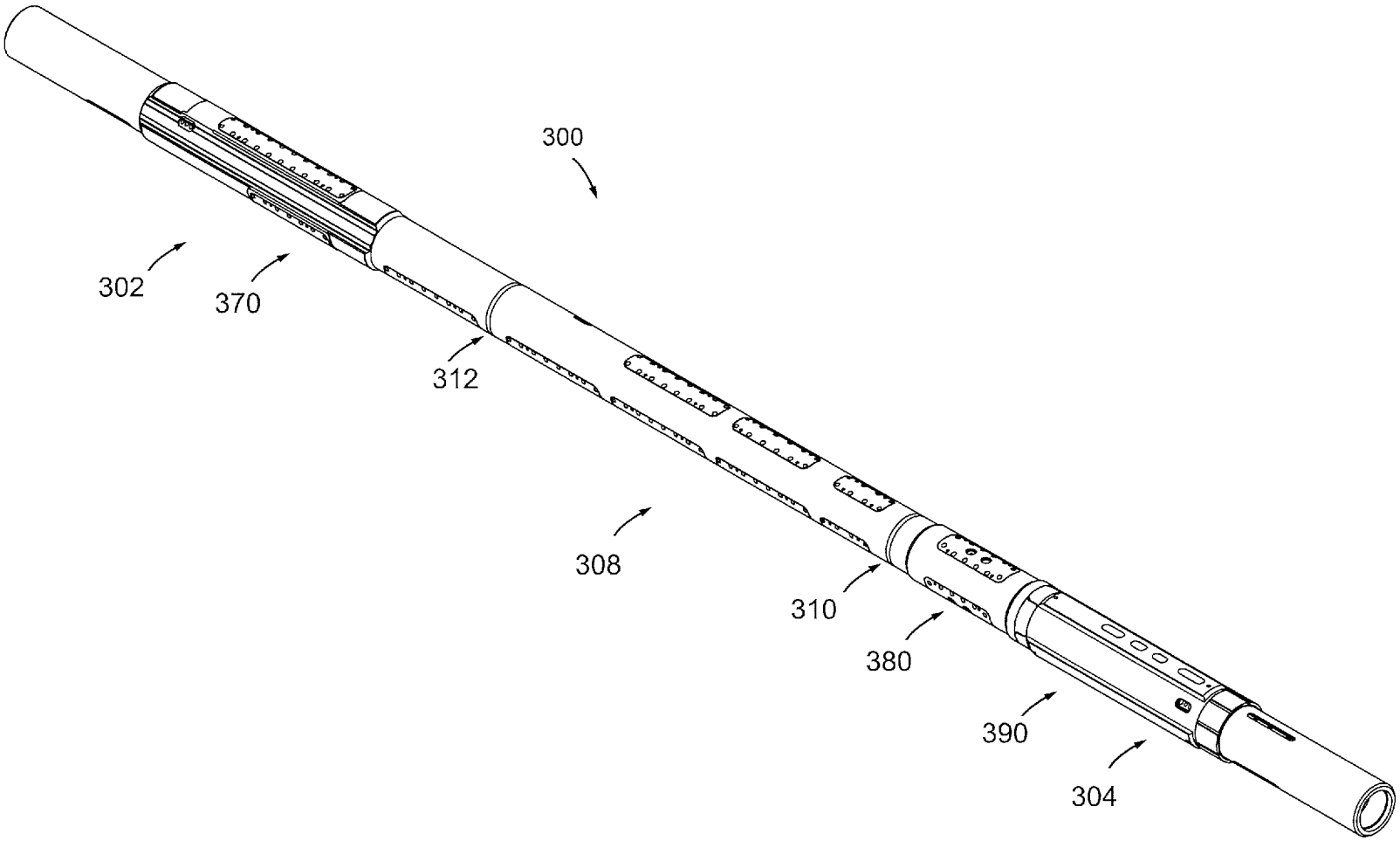
FIG. 13 is a perspective view of a triple combo tool according to an embodiment of the present disclosure.
Figure 14:
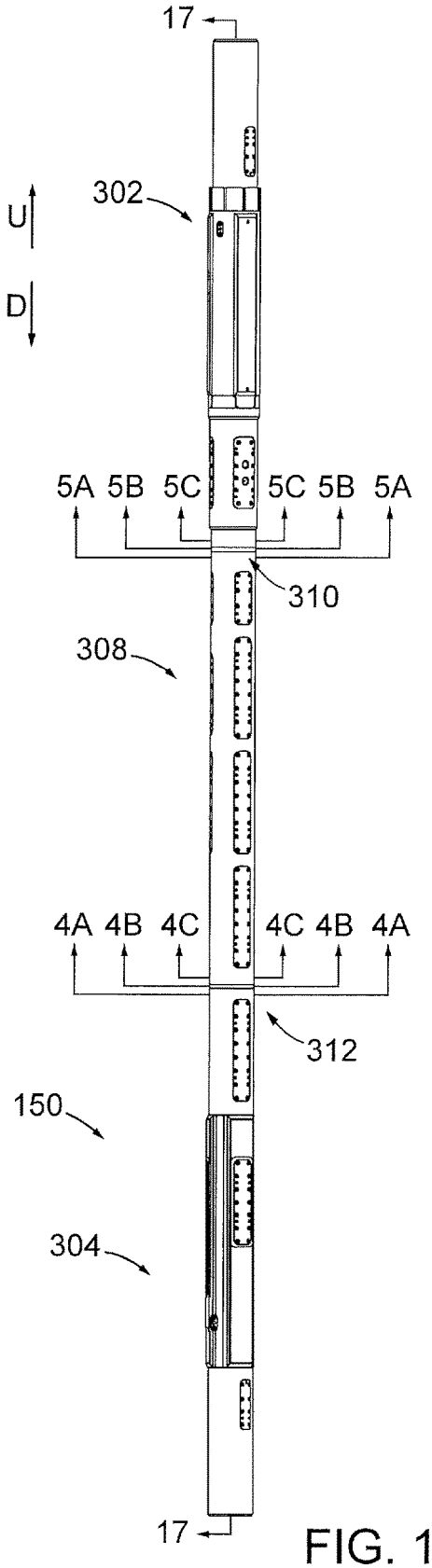
FIG. 14 is a side view of the triple combo tool logging tool shown in FIG. 13.
Figure 15A:
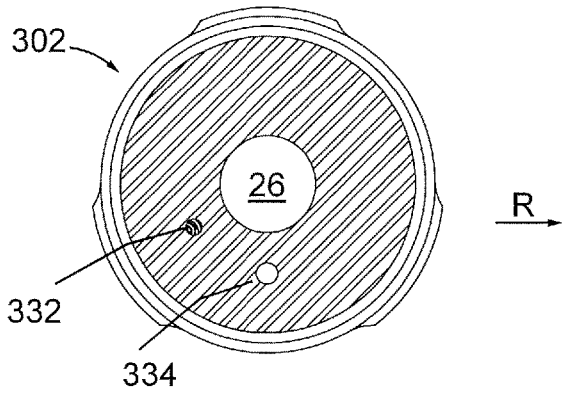
FIG. 15A is a cross-sectional view of the tool shown in FIG. 13 taken along line 4A-4A.
Figure 15B:
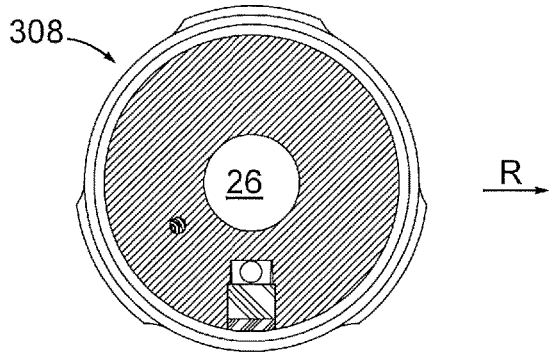
FIG. 15B is a cross-sectional view of the tool shown in FIG. 13 taken along line 4B-4B.
Figure 15C:
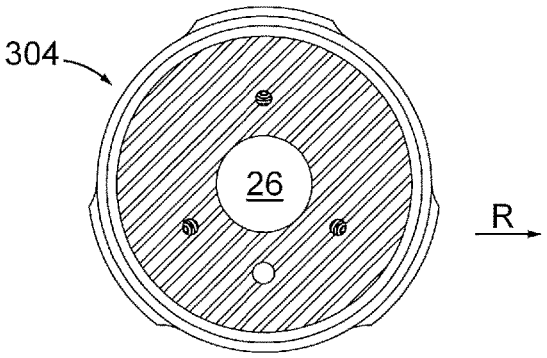
FIG. 15C is a cross-sectional view of the tool shown in FIG. 13 taken along line 4C-4C.
Figure 16A:
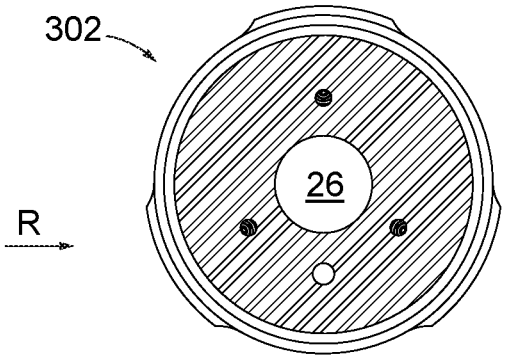
FIG. 16A is a cross-sectional view of the tool shown in FIG. 13 taken along line 5A-5A.
Figure 16B:
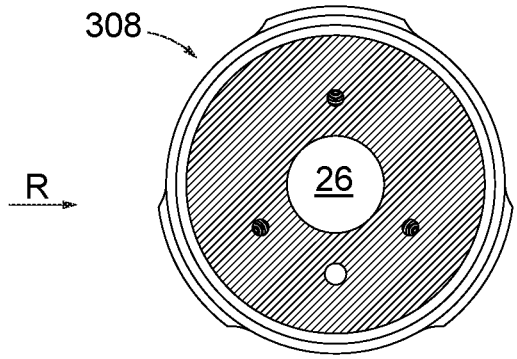
FIG. 16B is a cross-sectional view of the tool shown in FIG. 13 taken along line 5B-5B.
Figure 16C:
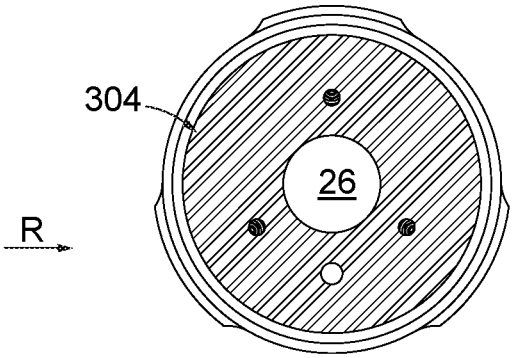
FIG. 16C is a cross-sectional view of the tool shown in FIG. 13 taken along line 5C-5C.

Referring to FIG. 12, the acoustic logging tool 100 includes one or more bores that extend through its component bodies. The bores, for example, 204, 208, are formed to house wires and other components of the acoustic logging tool 100. The bores are also formed to be open through the various weldments that mount the tool sections together. For example, the acoustic logging tool 100 can define a feedthrough bore that extends from the receiver section 102, through the isolator section 108, and to the transmitter section 104 along the axial direction A. In accordance with the illustrated embodiment, the feedthrough bore can be comprised of a first feedthrough bore (not shown) defined by the receiver section 102, a second feedthrough bore 208 defined by the isolator section 108, and a third feedthrough bore 204 defined by the transmitter section 104. The first, second, and third feedthrough bores 208, 204, respectively, are aligned along the axial direction A and but are offset with respect to the central bore 115 through which drilling mud flows.

Continuing to FIG. 12, a lower weldment 112 mounts the transmitter section 104 to the isolator section 108. The lower weldment 112 defines a slot 212 machined into the lower weldment 112 that extends inwardly from an outer surface of the lower weldment 112 along the radial direction R. The slot 212 is configured to be open to first and second bores 204 and 208. The slot 212 can include a slot cover 214 disposed within the slot 212, such that the slot cover 214 and the lower weldment 112 collectively define a slot bore 216 that is aligned with the first bore (not shown) and the second bore 208 along the axial direction A. The lower weldment 112 can also include a sealing weld 218 that secures the slot cover 214 within the slot, such that the slot cover 214 is positioned between the sealing weld 218 and the slot bore 216 along the radial direction R. Though one slot is described as extending through the lower weldment 112, the lower weldment 112 can define multiples slots as desired.

The upper weldment 110 is formed between the isolator section 108 and the receiver section 102. The upper weldment 110 is similar in construction to the lower weldment 112 shown in FIG. 5. For instance, the upper weldment 110 includes a slot that is open to bores, a slot cover in the lower slot and a lower sealing weld that secures the lower slot cover within the lower slot. Though an upper and lower weldment 110 and 112 are specifically described, it is contemplated that the acoustic logging tool 100 can include more or less weldments. The upper and lower weldments attach multiple sections of the acoustic logging tool 100 together while allowing open communication for bores to route wires as needed.

Referring to FIGS. 13-20, a downhole tool is shown in the form of a triple combo tool 300. The triple combo tool 300 includes a downhole section 304, an uphole section 302 spaced uphole from the downhole section 104 along an axial direction A, and an intermediate section 108. The intermediate section 308 extends from the downhole section 304 to the uphole section 302. The intermediate section 308 may be joined to the uphole section 302 by an upper weldment 310 and to the downhole section 304 by a lower weldment 312. An internal passage 26 extends through the tool 300. The upper and lower weldments 310 and 312 are formed as described above with respect to FIG. 12 and include that same features and elements as weldments 110 and 112.

In the illustrated embodiment, the triple combo tool 300 has an uphole section that includes 302 a neutron porosity sensor 370. The intermediate tool section 308 includes the cavity 350 for housing electronic components for operation and control of the downhole tool 300. The downhole section includes an acoustic caliper 380 module and a litho-density sensor 390. The triple combo tool includes one or more deep bores 332 and 334 that extend through the two or three of tool sections. The bores 332 and 334 may extend through the respective weldments 310, 312 as needed.

Figure 17:
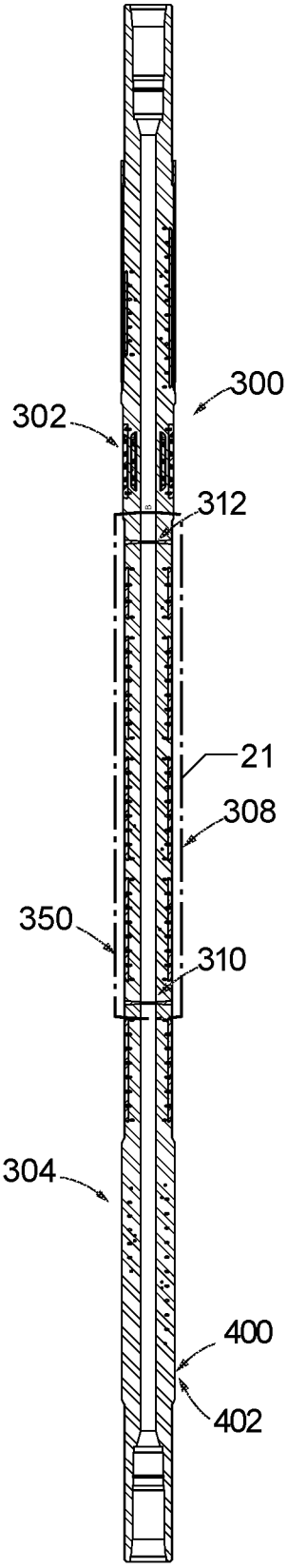
FIG. 17 is a cross-sectional view of the tool shown in FIG. 13 taken along line 17-17.
Figure 18:
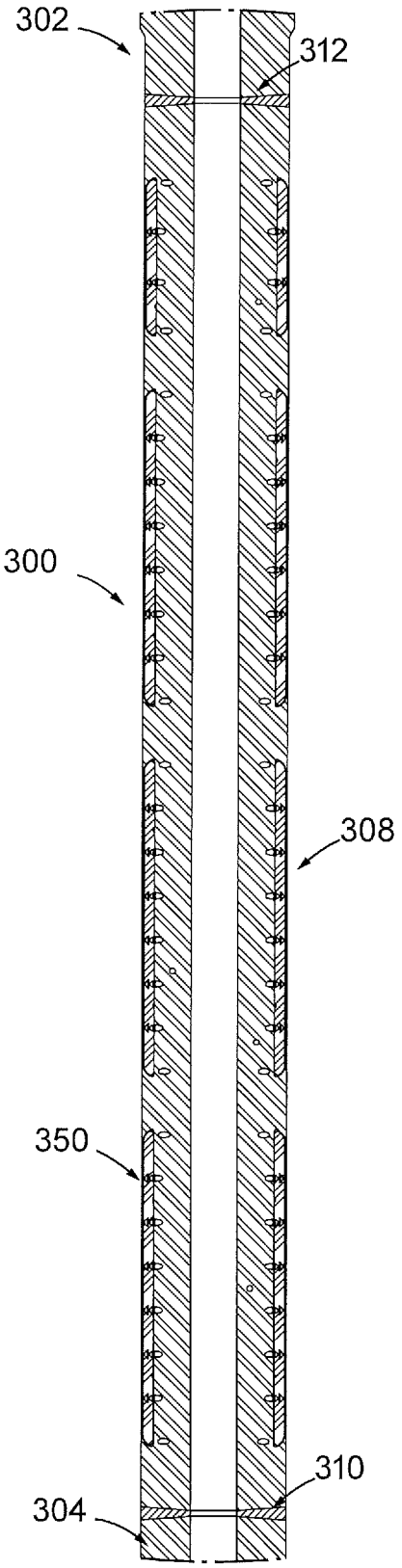
FIG. 18 is a detailed sectional view of a portion of the tool shown in FIG. 17.
Figure 19:
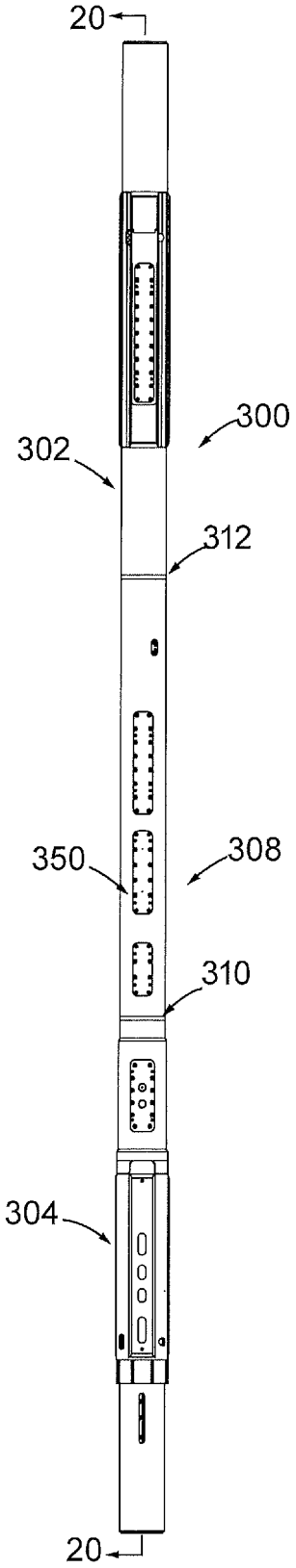
FIG. 19 is another side view of the tool.
Figure 20:
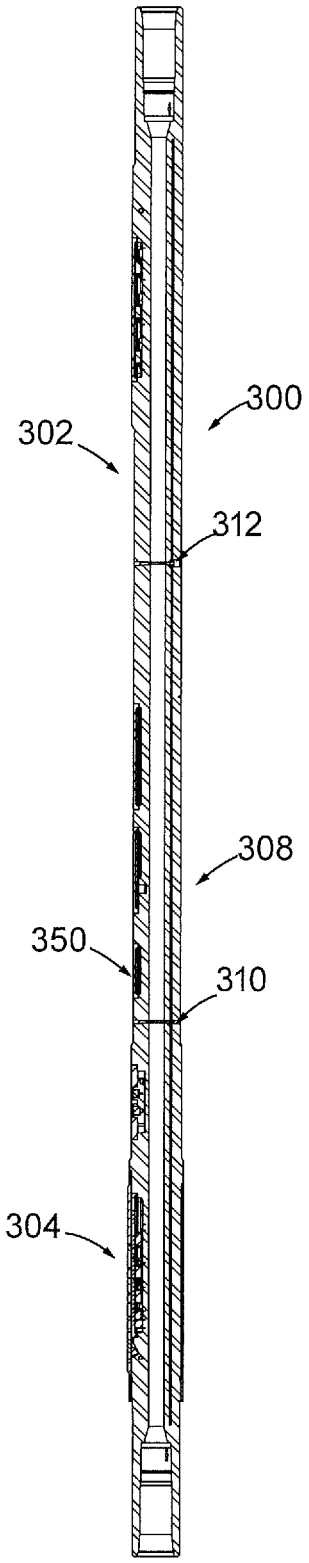
FIG. 20 is a cross-sectional view of the tool shown in FIG. 19 taken along line 20.

Another embodiment of the present disclosure is a downhole tool configured with a directional steering tool 400 (FIG. 17). The directional steering tool 400 may be in form of rotary steerable tool or a rotary steerable motor. In such an embodiment, the directional steering tool 400 includes a downhole section, an uphole section spaced uphole from the downhole section along an axial direction A, and an intermediate section. The intermediate section extends from the downhole section to the uphole section. The intermediate section may be joined to the uphole section by an upper weldment and to the downhole section by a lower weldment. An internal passage extends through the tool. The upper and lower weldments and are formed as described above with respect to FIG. 12 and include that same features and elements as weldments 110 and 112 and 310 and 312. The directional steering tool 400 may include a guidance module 402. The guidance module 402 may comprise a housing having a portion of the drive shaft (from the mud motor) therein, and at least one an actuating arm movably mounted on the housing. The guidance module 402 also has a hydraulic system comprising a pump having an outlet for discharging a pressurized hydraulic fluid, a piston disposed in a cylinder formed in the housing so that the piston can extend from the cylinder and urge the actuating arm away from the housing in response to the pressurized hydraulic fluid, and a valve for selectively placing the cylinder in fluid communication with the outlet of the pump. The directional steering tool 400 may include other features, including more deep bores and that extend through the two or three of tool sections, structural features, such as pockets, or other geometric features that have interconnecting deep bores for passages of wires and/or other components, such a hydraulic oil.

It will be appreciated by those skilled in the art that various modifications and alterations of the present disclosure can be made without departing from the broad scope of the appended claims. Some of these have been discussed above and others will be apparent to those skilled in the art. The scope of the present disclosure is limited only by the claims.

What is claimed is:

1. A downhole tool for determining a characteristic of a ground formation during a drilling operation, the downhole tool comprising:

a downhole section;

an intermediate tool section mounted to the downhole section by a lower weldment;

an uphole section positioned opposite the downhole section along an axial direction and mounted to the intermediate tool section by an upper weldment;

an elongate passage that extends from the downhole section to the uphole section through the lower weldment and the upper weldment, the elongate passage sized to receive drilling fluid therethrough; and wherein one or more of the downhole section, the intermediate tool section, and the uphole section includes: a) at least one sensor module, b) a cavity, and c) a plurality of bores that extend through the lower weldment and the upper weldment.

2. The downhole tool of claim 1, wherein the plurality of bores is a first bore, a second bore, and a third bore, wherein the uphole section defines the first bore, the intermediate tool section defines the second bore that is aligned with the first bore, and the downhole section defines the third bore that is aligned with the second bore.

3. The downhole tool of claim 2, wherein the first bore, the second bore, and third bore are configured to a) contain at least one wire, or b) as a hydraulic passage.

4. The downhole tool of claim 3, wherein the lower weldment comprises:

a lower slot that is open to the second and third bores;

a lower slot cover in the lower slot; and a lower sealing weld that secures the lower slot cover within the lower slot.

5. The downhole tool of claim 4, wherein the upper weldment comprises:

an upper slot that is open to the first and second bores;

an upper slot cover in the upper slot; and an upper sealing weld that secures the upper slot cover within the upper slot.

6. The downhole tool of claim 1, wherein the lower weldment and the upper weldment are configured to maintain structural integrity of the downhole tool.

7. The downhole tool of claim 1, wherein the downhole section includes a neutron porosity sensor, wherein the intermediate tool section includes the cavity for housing electronic components for operation and control of the downhole tool, wherein the uphole section includes an acoustic caliper module and a litho-density sensor.

8. The downhole tool of claim 1, wherein each weldment extends circumferentially around the downhole tool.

9. The downhole tool of claim 1, wherein the intermediate section includes an acoustic isolator.

10. The downhole tool of claim 1, wherein the downhole section, the intermediate section, or the uphole section includes directional steering system for controlling the direction of drilling.

11. The downhole tool of claim 10, wherein the directional steering system comprises:

a guidance module the guidance module being movable between an extended position and a retracted position.

12. A triple combo downhole tool for determining a characteristic of a ground formation during a drilling operation, the tool comprising:

a downhole section including a neutron porosity sensor; an intermediate tool section mounted to the downhole section by a lower weldment, the intermediate tool section include at least one cavity for housing electronic components for operation and control of the downhole tool;

an uphole section opposite the downhole section along an axial direction and mounted to the intermediate tool section by an upper weldment, the uphole section including an acoustic caliper module and a litho-density sensor;

an elongate passage that extends from the downhole section to the uphole section through the lower weldment and the upper weldment, the elongate passage sized to receive drilling fluid therethrough; and a plurality of bores that extend through the lower weldment and the upper weldment and further extend through one or more of the downhole section, the intermediate tool section and the uphole section.

13. The downhole tool of claim 12, wherein the plurality of bores is a first bore, a second bore, and a third bore, wherein the uphole section defines the first bore, the intermediate tool section defines the second bore that is aligned with the first bore, and the downhole section defines the third bore that is aligned with the second bore.

14. The downhole tool of claim 13, wherein the first bore, the second bore, and third bore are configured to a) contain at least one wire, or b) as a hydraulic passage.

15. The downhole tool of claim 13, wherein the lower weldment comprises:

a lower slot that is open to the second and third bores;

a lower slot cover in the lower slot; and a lower sealing weld that secures the lower slot cover within the lower slot.

16. The downhole tool of claim 15, wherein the upper weldment comprises:

an upper slot that is open to the first and second bores;

an upper slot cover in the upper slot; and an upper sealing weld that secures the upper slot cover within the upper slot.

17. The downhole tool of claim 12, wherein the lower weldment and the upper weldment are configured to maintain structural integrity of the downhole tool.

18. The downhole tool of claim 12, wherein each weldment extends circumferentially around the downhole tool.

19. An acoustic logging tool for determining a characteristic of a ground formation during a drilling operation, the acoustic logging tool comprising:

a transmitter section that includes a transmitter that is configured to emit an acoustic signal;

an isolator section mounted to the transmitter section by a lower weldment, the isolator section defining a plurality of isolator cavities that extend into the isolator section along a radial direction, wherein the plurality of isolator cavities are configured to disrupt a portion of the acoustic signal propagating through the isolator section emitted from the transmitter;

a receiver section mounted to the isolator section by an upper weldment and positioned opposite the transmitter section along an axial direction, the receiver section including a receiver that is configured to receive at least a portion of the acoustic signal;

an elongate passage that extends from the transmitter section to the receiver section through the lower weldment and upper weldment, the elongate passage sized to receive drilling fluid therethrough; and a plurality of bores that extend through the lower weldment and the upper weldment and further extend through at least one of the transmitter section and the receiver section.

20. The acoustic logging tool of claim 19, wherein the plurality of bores is a first bore, a second bore, and a third bore, wherein the receiver section defines the first bore, the isolator section defines the second bore that is aligned with the first bore, and the receiver section defines the third bore that is aligned with the second bore, wherein the first bore, the second bore and the third bores each contain at least one wire.

21. The acoustic logging tool of claim 20, wherein the upper weldment comprises:

an upper slot that is open to the first and second bores;

an upper slot cover in the upper slot; and an upper sealing weld that secures the upper slot cover within the upper slot.

22. The acoustic logging tool of claim 19, wherein the lower weldment comprises:

a lower slot that is open to the second and third bores;

a lower slot cover in the lower slot; and a lower sealing weld that secures the lower slot cover within the lower slot.

23. The acoustic logging tool of claim 19, wherein the lower weldment and the upper weldment are configured to maintain structural integrity of the acoustic logging tool.

24. The acoustic logging tool of claim 19, wherein each weldment extends circumferentially around the downhole tool.

25. A downhole tool for determining a characteristic of a ground formation during a drilling operation, the downhole tool comprising:

a downhole section;

an intermediate tool section mounted to the downhole section by a lower weldment, the lower weldment including a) a lower slot that is open to the second and third bores, b) a lower slot cover in the lower slot, and c) a lower sealing weld that secures the lower slot cover within the lower slot;

an uphole section positioned opposite the downhole section along an axial direction and mounted to the intermediate tool section by an upper weldment, the upper weldment including a) an upper slot that is open to the first and second bores, b) an upper slot cover in the upper slot; and c) an upper sealing weld that secures the upper slot cover within the upper slot;

an elongate passage that extends from the downhole section to the uphole section through the lower weldment and the upper weldment, the elongate passage sized to receive drilling fluid therethrough; and wherein one or more of the downhole section, the intermediate tool section, and the uphole section includes: a) at least one sensor module, b) a cavity, and c) at least a first bore, a second bore, and a third bore, wherein the uphole section defines the first bore, the intermediate tool section defines the second bore that is aligned with the first bore, and the downhole section defines the third bore that is aligned with the second bore.

26. The downhole tool of claim 25, wherein the downhole section includes a neutron porosity sensor, wherein the intermediate tool section includes the cavity for housing electronic components for operation and control of the downhole tool, wherein the uphole section includes an acoustic caliper module and a litho-density sensor.

27. A triple combo downhole tool for determining a characteristic of a ground formation during a drilling operation, the tool comprising:

a downhole section including a neutron porosity sensor;

an intermediate tool section mounted to the downhole section by a lower weldment, the lower weldment including a) a lower slot that is open to the second and third bores, b) a lower slot cover in the lower slot, and c) a lower sealing weld that secures the lower slot cover within the lower slot, the intermediate tool section include at least one cavity for housing electronic components for operation and control of the downhole tool;

an uphole section opposite the downhole section along an axial direction and mounted to the intermediate tool section by an upper weldment, wherein the upper weldment includes a) an upper slot that is open to the first and second bores, b) an upper slot cover in the upper slot, and c) an upper sealing weld that secures the upper slot cover within the upper slot, the uphole section including an acoustic caliper module and a litho-density sensor;

an elongate passage that extends from the downhole section to the uphole section through the lower weldment and the upper weldment, the elongate passage sized to receive drilling fluid therethrough; and at least a first bore, a second bore, and a third bore that extend through one or more of the downhole section, the intermediate tool section, and the uphole section, wherein the uphole section defines the first bore, the intermediate tool section defines the second bore that is aligned with the first bore, and the downhole section defines the third bore that is aligned with the second bore.

28. The downhole tool of claim 27, wherein each weldment extends circumferentially around the downhole tool.

29. An acoustic logging tool for determining a characteristic of a ground formation during a drilling operation, the acoustic logging tool comprising:

a transmitter section that includes a transmitter that is configured to emit an acoustic signal; an isolator section mounted to the transmitter section by a lower weldment, the lower weldment including a) a lower slot that is open to the second and third bores, b) a lower slot cover in the lower slot, and c) a lower sealing weld that secures the lower slot cover within the lower slot, the isolator section defining a plurality of isolator cavities that extend into the isolator section along a radial direction, wherein the plurality of isolator cavities are configured to disrupt a portion of the acoustic signal propagating through the isolator section emitted from the transmitter;

a receiver section mounted to the isolator section by an upper weldment and positioned opposite the transmitter section along an axial direction, the upper weldment including a) an upper slot that is open to the first and second bores, b) an upper slot cover in the upper slot, and c) an upper sealing weld that secures the upper slot cover within the upper slot, the receiver section including a receiver that is configured to receive at least a portion of the acoustic signal;

an elongate passage that extends from the transmitter section to the receiver section through the lower weldment and upper weldment, the elongate passage sized to receive drilling fluid therethrough; and a plurality of bores that extend through at least one of the transmitter section, the isolator section and the receiver section, wherein the plurality of bores is a first bore, a second bore, and a third bore, wherein the receiver section defines the first bore, the isolator section defines the second bore that is aligned with the first bore, and the receiver section defines the third bore that is aligned with the second bore, and wherein the first bore, the second bore and the third bores each contain at least one wire.

30. The acoustic logging tool of claim 27, wherein each weldment extends circumferentially around the downhole tool.

* * * * *